US005607108A

United States Patent [19]

Garlick et al.

[11] Patent Number: 5,607,108

[45] Date of Patent: Mar. 4, 1997

[54] NOZZLE AND AIRCAP FOR SPRAY GUNS

[75] Inventors: Paul L. Garlick, Poole; Neville T. Pettit, Lymington, both of United Kingdom

[73] Assignee: ITW Limited, Windsor, United Kingdom

[21] Appl. No.: 528,281

[22] Filed: Sep. 14, 1995

[30] Foreign Application Priority Data

Oct. 10, 1994 [GB] United Kingdom ..... 9420375

[51] Int. Cl.[6] ..... B05B 7/06

[52] U.S. Cl. ..... 239/424; 239/417.3

[58] Field of Search ..... 239/423, 416.4, 239/416.5, 424, 417.3, 418, 429, 340, 346, DIG. 1

[56] References Cited

U.S. PATENT DOCUMENTS

| | | | |
|---|---|---|---|
| 2,051,210 | 8/1936 | Gustafsson | 239/290 |
| 2,102,382 | 12/1937 | Roselund | 239/290 |
| 2,172,193 | 9/1939 | Downs | 239/416.4 X |
| 3,515,354 | 6/1970 | Presson | 239/416.5 |
| 4,963,330 | 10/1990 | Johansson et al. | 239/290 X |
| 5,540,385 | 7/1996 | Garlick | 239/290 |

FOREIGN PATENT DOCUMENTS

| | | | |
|---|---|---|---|
| 72950 | 3/1983 | European Pat. Off. . | |
| 1528571 | 5/1968 | France | 239/290 |
| 808538 | 7/1949 | Germany | 239/290 X |
| 858769 | 7/1951 | Germany | 239/290 |
| 657968 | 10/1951 | United Kingdom . | |
| 954403 | 6/1964 | United Kingdom . | |
| 960056 | 6/1964 | United Kingdom . | |
| 1188761 | 4/1976 | United Kingdom . | |

*Primary Examiner*—Kevin Weldon
*Attorney, Agent, or Firm*—Schwartz & Weinrieb

[57] ABSTRACT

A nozzle and aircap for spray guns is described comprising a nozzle with a screw-threaded end for threaded engagement with to a spray gun. The front of the nozzle has a shoulder with a hexagonal central boss and eight holes forming passages for air passing through the spray gun. The boss tapers to a projecting fluid discharge end of the nozzle with a radius measuring 0.117 inch (2.971 mm). The discharge end extends with a straight parallel nozzle outlet for a distance of 0.0311 inch (0.787 mm). The discharge outlet of the nozzle is spaced rearwardly from the leading face of the aircap (0.1533 mm), and a central aperture is chamfered toward the leading face of the aircap and has an axial depth of 0.021 inches (0.533 mm).

16 Claims, 1 Drawing Sheet

NOZZLE AND AIRCAP FOR SPRAY GUNS

FIELD OF THE INVENTION

This invention relates to an improved nozzle and aircap design, and more particularly for suction and cavity feed air-atomized spray guns where the spray material is drawn to the nozzle outlet by aerodynamic forces generated as a result of the geometrical arrangement of the nozzle and the aircap.

BACKGROUND OF THE INVENTION

In current spray guns of the aforementioned type the nozzle supplying the fluid to be sprayed projects up to or beyond the leading face of a surrounding aircap. The flow of the air out of the aircap draws the fluid through the nozzle, breaks the fluid jet into droplets, and disperses the resultant spray. The more air that is required to do this the noisier and less efficient is the process. Therefore designers have looked at various means of improving (reducing) the ratio between the air consumption of the aircap and the flow rate of the spray face of the nozzle have previously been found to reduce the fluid flow and make the aircap prone to droplet deposition and consequent dirtying.

OBJECT OF THE INVENTION

An aim of the present invention is to increase the efficiency of nozzle and aircap combinations by reducing the air to fluid ratio without causing any dirtying of the aircap.

SUMMARY OF THE INVENTION

According to one aspect of the present invention there is provided a nozzle and aircap for spray guns, comprising a central nozzle for a fluid to be sprayed, encircled by an aircap wherein the discharge outlet of the nozzle is spaced rearwardly from the leading face of the aircap, and a central aperture of the aircap is chamfered towards file leading face of the aircap.

Preferably, the distance between the discharge outlet of the nozzle and the leading face of the aircap is 0.060 inch (1.524 mm).

Conveniently, the central aperture formed in the aircap encircling the nozzle is chamfered at an angle of 45° with a depth (b) of 0.021 inch (0.533 mm).

In a preferred construction, the passage between the nozzle and aircap forms a converging/diverging passage so as to restrict the flow of air leaving the leading face of the aircap.

According to a second aspect of the present invention there is provided a spray gun incorporating a nozzle and aircap as set forth in the four preceeding paragraphs.

BRIEF DESCRIPTION OF THE DRAWINGS

Various other objects, features, and attendant advantages of the present invention will be more fully appreciated from the following detailed description of embodiments of the invention which will now be described, by way of example only, with reference to the accompanying drawings, in which: like reference characters designate like or corresponding parts throughout the several views, and wherein.

DETAILED DESCRIPTION OF THE ILLUSTRATED EMBODIMENTS

Figure 1:
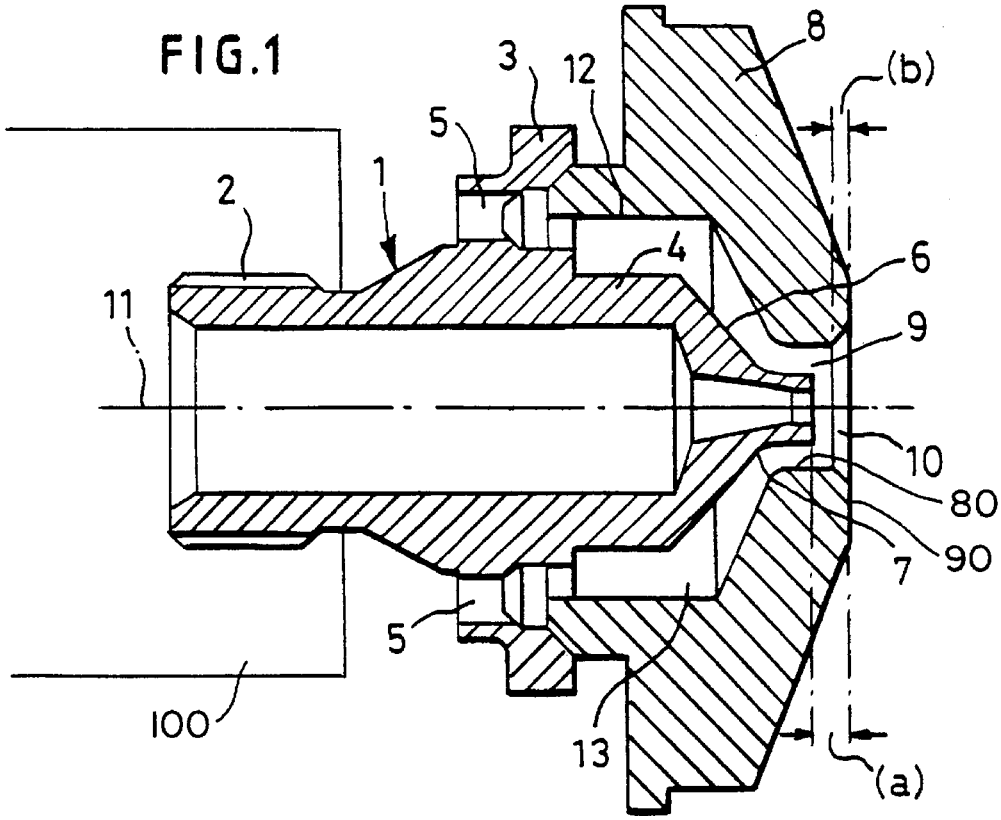
FIG. 1 is an enlarged fragmentary axial section of an improved nozzle and aircap according to the invention.
Figure 2:
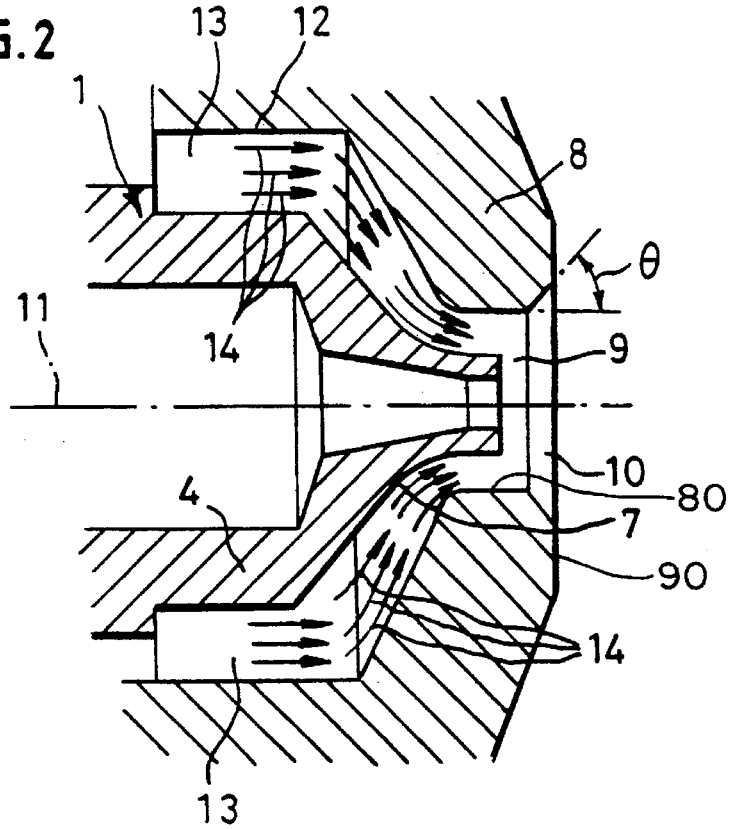
FIG. 2 is an enlarged portion of the axial section shown in FIG. 1.

The improved nozzle and aircap design illustrated in FIGS. 1 and 2 comprises a nozzle 1 with a screw-threaded end 2 for threaded engagement with a spray gun generally indicated by the reference character 100. The front end of the nozzle has a circular shoulder 3 with a hexagonal central boss 4 and a series of eight parallel holes 5 forming passages for air passing through the spray gun. The hexagonal boss 4 tapers to a projecting fluid discharge end 6 of the nozzle with a blending radius 7 measuring 0.117 inch (2.971 mm). The discharge end 6 extends with a straight parallel nozzle outlet for a distance of 0.0311 inch (0.787 mm).

The discharge outlet of the nozzle is spaced rearwardly from the leading face 90 of an aircap 8 by a distance (a) of 0.060 inch (1.524 mm).

A central aperture 9 formed in the aircap 8 is chamfered at 10 towards the leading face of the aircap at an angle of 45° with a depth (b) of 0.021 inch (0.533 mm).

At the rear of the aperture 9 in the aircap 8, the aircap 8 is shaped with a radiused portion 80 of 0.0197 inch (0.50 mm), and runs parallel to the nozzle axis 11 and sweeps upwardly and rearwardly to a parallel wall 12. The space 13 between the nozzle 1 and aircap 8 forms a converging/diverging passage restricting the flow of air leaving the leading face of the aircap as shown by the arrows 14.

Preferably, the air pressure in the space 13 is 10 psig.

The improved design of the nozzle and aircap provides a 10% reduction of the air to fluid ratio in a typical case and the chamfer on the end of the aircap outlet ensures that this reduction is not marred by any dirtying of the aircap.

Obviously, many modifications and variations of the present invention are possible in light of the above teachings. It is therefore to be understood that within the scope of the appended claims, the present invention may be practiced otherwise than as specifically described herein.

We claim:

1. A nozzle and aircap assembly for spray guns, comprising:

a longitudinal nozzle for spraying a fluid to be sprayed, and having a longitudinal axis and a discharge outlet annularly surrounding said longitudinal axis; and an aircap encircling said nozzle and having a discharge outlet annularly surrounding said fluid discharge outlet of said nozzle;

said discharge outlet of said aircap comprising a substantially planar leading face disposed substantially perpendicular to said longitudinal axis of said nozzle; an annular wall having an axial extent disposed parallel to said longitudinal axis of said nozzle and defining a central aperture within said aircap and within which said discharge outlet of said nozzle is disposed such that said discharge outlet of said nozzle is spaced rearwardly from said leading face of said aircap; and said annular wall of said aircap defining said central aperture within said aircap comprises a chamfered portion integrally interconnecting said axial extent thereof and said leading face of said aircap so as to optimize fluid and air flow out from said discharge outlet of said aircap without obstructing said fluid and air flow discharged from said discharge outlet of said aircap.

2. A nozzle and aircap as claimed in claim 1, wherein the distance between the discharge outlet of said nozzle and said leading face of said aircap is 0.060 inch (1.524 mm).

3. A nozzle and aircap as claimed in claim 1, wherein said central aperture formed in said aircap encircling said nozzle is chamfered at an angle of 45° with a depth of 0.021 inch (0.533 mm).

4. A nozzle and aircap as claimed in claim 1, wherein a passage formed between said nozzle and aircap forms a converging/diverging passage to restrict the flow of air leaving said leading face of said aircap.

5. A spray gun, comprising a longitudinal nozzle for spraying a fluid to be sprayed, and having a longitudinal axis and a discharge outlet annularly surrounding said longitudinal axis; and an aircap encircling said nozzle and having a discharge outlet annularly surrounding said fluid discharge outlet of said nozzle;

said discharge outlet of said aircap comprising a substantially planar leading face disposed substantially perpendicular to said longitudinal axis of said nozzle; an annular wall having an axial extent disposed parallel to said longitudinal axis of said nozzle and defining a central aperture within said aircap and within which said discharge outlet of said nozzle is disposed such that said discharge outlet of said nozzle is spaced rearwardly from said leading face of said aircap; and said annular wall of said aircap, defining said central aperture within said aircap, comprises a chamfered portion integrally interconnecting said axial extent thereof and said leading face of said aircap so as to optimize fluid and air flow out from said discharge outlet of said aircap without obstructing said fluid and air flow discharged from said discharge outlet of said aircap.

6. A nozzle and aircap assembly as set forth in claim 1, wherein:

an upstream end portion of said nozzle comprises screw-threaded means for threaded engagement with a spray gun.

7. A nozzle and aircap assembly as set forth in claim 4, wherein:

an annular shoulder portion of said nozzle has a plurality of parallel holes formed therein for defining air passages therein and fluidically connected to said air passage defined between said nozzle and said aircap for providing air to said air passage defined between said nozzle and said aircap.

8. A nozzle and aircap assembly as set forth in claim 7, wherein:

said plurality of parallel holes comprises eight holes.

9. A nozzle and aircap assembly as set forth in claim 1, wherein:

said discharge outlet of said nozzle comprises an axially extending portion concentric with respect to said longitudinal axis of said nozzle, and concentric with and parallel to said axial extent of said annular wall of said discharge outlet of said aircap.

10. The spray gun as set forth in claim 5, wherein:

the distance defined between said discharge outlet of said nozzle and said leading face of said aircap is 0.060 inches (1,524 mm).

11. The spray gun as set forth in claim 5, wherein:

said chamfered portion of said discharge outlet of said aircap defines an angle of 45° with respect to said longitudinal axis of said nozzle and has an axial extent of 0.021 inches (0.533 mm).

12. The spray gun as set forth in claim 5, wherein:

a passage defined between said nozzle and said aircap forms a converging/diverging passage so as to restrict the flow of air discharged by said discharge outlet of said aircap.

13. The spray gun as set forth in claim 5, wherein:

an upstream end portion of said nozzle comprises screw-threaded means for threaded engagement with said spray gun.

14. The spray gun as set forth in claim 12, wherein:

an annular shoulder portion of said nozzle has a plurality of parallel holes defined therein for defining air passages therein which are fluidically connected to said air passage defined between said nozzle and said aircap for providing air to said air passage defined between said nozzle and said aircap.

15. The spray gun as set forth in claim 14, wherein:

said plurality of parallel holes comprises eight holes.

16. The spray gun as set forth in claim 5, wherein:

said discharge outlet of said nozzle comprises an axially extending portion concentric with respect to said longitudinal axis of said nozzle, and concentric with and parallel to said axial extent of said annular wall of said discharge outlet of said air-cap.

* * * * *